US006398449B1

(12) United States Patent
Loh

(10) Patent No.: US 6,398,449 B1
(45) Date of Patent: Jun. 4, 2002

(54) LINEAR CONNECTOR OF PLASTIC MATERIAL FOR JOINING SPACING PROFILES OF MULTIPLE INSULATING GLASSES

(75) Inventor: Walter Loh, Kaufbeuren-Neugablonz (DE)

(73) Assignee: Cera Handelsgesellschaft mbH (DE)

( * ) Notice: Subject to any disclaimer, the term of this patent is extended or adjusted under 35 U.S.C. 154(b) by 0 days.

(21) Appl. No.: 09/532,290

(22) Filed: Mar. 23, 2000

(30) Foreign Application Priority Data

May 4, 1999 (DE) ..... 299 07 938
Oct. 12, 1999 (DE) ..... 299 18 002

(51) Int. Cl.[7] ..... B25G 3/28

(52) U.S. Cl. ..... 403/280; 403/292; 403/314; 403/408.1

(58) Field of Search ..... 411/508–510, 913, 411/389, 280; 403/292, 298, 288, 314, 408.1

(56) References Cited

U.S. PATENT DOCUMENTS 4,902,182 A * 2/1990 Lewis ..... 411/510
5,487,245 A * 1/1996 Dazo et al. ..... 52/204.61
5,603,582 A 2/1997 Loh
5,907,891 A * 6/1999 Meyer ..... 411/510

FOREIGN PATENT DOCUMENTS

| | | |
|---|---|---|
| DE | 92 16 955.4 | 5/1994 |
| EP | 0 283 689 B1 | 9/1988 |
| EP | 0 750 090 B1 | 12/1996 |
| EP | 0778389 A1 * | 6/1997 |

* cited by examiner

*Primary Examiner*—Lynne H. Browne
*Assistant Examiner*—Aaron M Dunwoody
(74) *Attorney, Agent, or Firm*—Gifford, Krass, Groh, Sprinkle, Anderson & Citkowski, P.C.

(57) ABSTRACT

A linear connector for joining metal spacing profiles for multiple insulated glass panes, includes a body that is adapted to be inserted into the hollow spaces of two spacing profiles. The body has a pair of brake blades positioned along lateral sides that are inclined toward the center. The brake blades are adapted to contact opposing front faces of the profile bodies upon insertion of the linear connector into the spacing profile. Spring blades project from the lateral sides of the body. The spring blades are positioned behind one another to form a V-configuration and are adapted to increase the frictional force between the body and the inner wall surfaces of the spacing profiles. Reinforcing elements, that are centrally positioned along lateral sides of the body, are connected to the said brake blades and are adapted to prevent passage of hygroscopic powder along the outside of the body.

10 Claims, 3 Drawing Sheets

LINEAR CONNECTOR OF PLASTIC MATERIAL FOR JOINING SPACING PROFILES OF MULTIPLE INSULATING GLASSES

BACKGROUND OF THE INVENTION

The invention concerns a linear connector of plastic material for joining hollow of metal consisting spacing profiles of multiple insulating glasses, comprising a flat, longitudinal body, which is insertable into the hollow space of the one spacing profile and the hollow space of the other spacing profile of the two spacing profiles which are to be connected to one another. The surface of that body is provided with abutment elements in form of elastic braking blades inclined to the surface and abutting during the insertion of the linear connector into the spacing profiles against the profile front faces opposite to one another. Moreover, the body is provided with blade-like springs extending from their small lateral sides which should increase the frictional force between the surface of the body and the inner wall surface of the spacing profiles. The longitudinal body comprises a completely or almost completely U-configured cross-section for the passage of a hygroscopic drying substance powder within this cross-section as well as in the center of its length on both small lateral sides protuberance-like reinforcing elements extending outwardly and in order to reinforce the body radially. These reinforcing elements are opposed by braking blades which will be pressed down by the front faces of the spacing profiles upon the insertion of the body into the hollow space of the spacing profiles. Moreover, these braking blades form an abutment for the spacing profile front faces upon insertion so that the insertion is stopped by them.

Linear connectors of the above mentioned kind are known from German Utility Model Registrations 8,816,799 and 9,216,955. These known linear connectors, however, are provided in mounted condition with certain drawbacks according to which they do not keep the spacing profiles together in an extent requested. Thus, it happens that the gap between the spacing profiles connected to one another opens so that hygroscopic drying substance powder enclosed in the hollow space of the profiles runs through this gap into the space between the two insulating glass panes polluting the same.

The above mentioned drawbacks are also not avoided by linear connectors for joining two parallel hollow spacing profile tracks according to U.S. Pat. No. 5,603,582, although they are provided with two pairs of two distantly separated, parallel legs extending in longitudinal direction of the spacing profile tracks and joined by an abutment rib extending across the longitudinal legs, which abutment rib is provided with front faces being engaged by the front faces of the hollow profile spacing tracks, if the linear connector is in mounted condition. Because this linear connector is not provided on its surface with pressure spring elements, however, the forces keeping the spacing profiles connected at the joining gap are rather weak.

A further linear connector known from German Patent 19,522,505 intended to be used especially for joining spacing profiles of steel comprises doubtlessly the requested strong seat as well as the required stiffness and resistance against abrashion and is also provided with abutments avoiding pushing too far on the insertion of the linear connector body into the hollow space of the spacing profiles. Nevertheless it has certain drawbacks concerning the requested sealing of the space between the glass panes in the area of the joining gap of the spacing profiles. The problems concerning that seal are especially due in case the hygroscopic powder substance as used is characterized by a grain analysis having a particularly high portion of fine grains. These fine grains possibly enter through the mentioned joining gap into the space between the glass panes and thus pollute the panes in an extent not tolerable. Moreover, it has been found out that under the above mentioned conditions the multiple insulating glass cannot fullfill its insulating purpose over long time.

In order to avoid the above mentioned drawbacks blade-like springs are used on the surface of such linear connectors increasing the frictional effect between the linear connector and the spacing profiles in order to keep the joining gap closed. These springs should be constructed such, however, that they keep their tension after mounting in an extent required for maintaining their pressure onto the inner wall surface of the spacing profiles.

The above mentioned requirements, however, are not completely fullfilled by the known linear connectors of the above mentioned kind.

SUMMARY OF THE INVENTION

It is therefore an object of the invention to develop the linear connector of the above mentioned kind further in order to improve the sealing effect between the body of the linear connector at the joining gap and the bodies of the spacing profiles which are to be joined.

In this connection it is a further object of the invention to manufacture the linear connector by using a lesser quantity of plastic material without effecting negatively its function, i.e. especially its stability and its resistance against bending forces.

According to a still further object of the invention it is intended to configure the springs such that their tension after the mounting of the linear connector in the hollow space of the spacing profiles is retained to an extent required in order to keep the joining gap between the spacing profiles as close as possible and in this connection to avoid any decrease of the tension of the springs after mounting and thus any decrease of the friction between the plastic material of the linear connector and the surrounding metal of the spacing profiles.

These and other objects of the invention are solved by a construction characterized in that essentially all blade-like extending springs are configured as double springs, comprising two spring blades arranged behind one another and forming together in general a V-configuration and supporting themselves after the linear connector having been mounted in the spacing profile in a mutual manner, and further characterized in that the protuberance-like reinforcing elements at the bottom of the longitudinal body are configured and arranged such that they form a bar against passing of the hygroscopic drying substance powder outwardly of the U-configured cross-section of the linear connector body.

Because of the supporting effect of that spring blade of each double spring being located in longitudinal direction behind after mounting of the connector body which has a greater angle of inclination to the longitudinal axis of the body as the front spring blade, the latter one develops an additional resistance against deformation without deminishing its spring suspension. This resistance is caused by the fact that the two spring blades are provided at the small lateral sides of the body having a common root and form, respectively. Thus, at the tip of the V an accumulation of material is provided introducing to the front spring blade a repulsion force without changing negatively its flexibility and the spring blade behind is functioning as a support to the front spring blade.

Concerning the protuberance-like reinforcing elements which are known per from the prior art and which are opposed by at least one abutment element in form of elastic brake blades inclined to the center of the body it ist true that during the insertion of the connector body into the hollow space of the spacing profiles these brake blades are pressed downwardly and are thereby plastically deformed. Thus, the reinforcing elements are configured and arranged such that they additionally perform a sealing function in the abutment area of the spacing profile body with respect to the hygroscopic drying substance powder passing through the hollow space of that body.

DESCRIPTION OF THE DRAWINGS

A better understanding of the invention will be reached by reference to the following detailed description when read in conjunction with the accompanying drawings in which.

DESCRIPTION OF THE PREFERRED EMBODIMENTS

Figure 1:
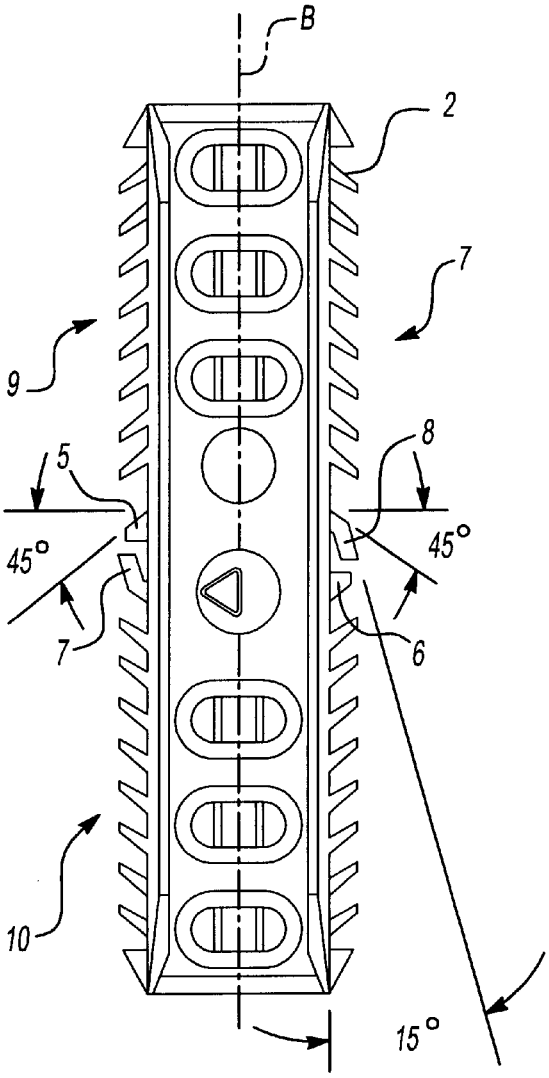
FIG. 1 is a schematical plan view of a first embodiment of the linear connector.

Each of the linear connectors as shown in the drawings is comprised of plastic material and is especially suited for joining hollow spacing profiles of steel for multiple insulating glasses. Each linear connector is provided with a flat, longitudinal body, one longitudinal piece 9 of which is insertable into the hollow space of the one spacing profile not shown in the drawings and the other longitudinal piece 10 is insertable into the hollow space of the other spacing profile, also not shown in the drawings, in order to join both spacing profile bodies immovably and tightly.

Figure 2:
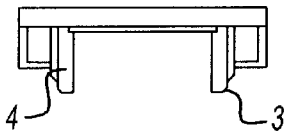
FIG. 2 is a schematical front view of the linear connector of FIG. 1.
Figure 3:
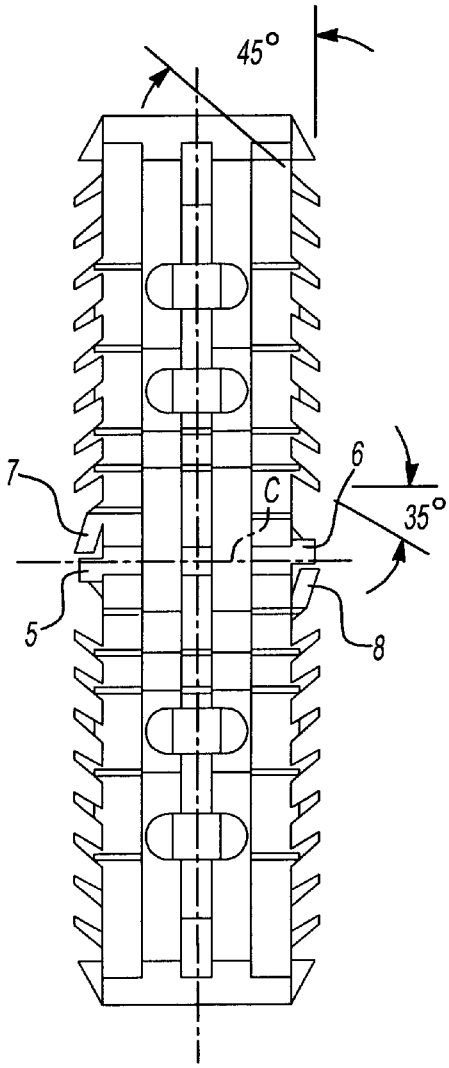
FIG. 3 is a schematical bottom view of the linear connector of FIG. 1.
Figure 4:
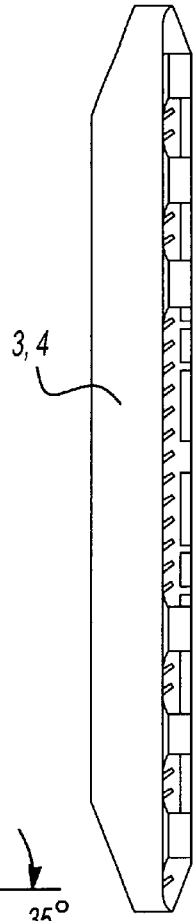
FIG. 4 is a longitudinal sectional lateral view of the linear connector of FIG. 1.
Figure 5:
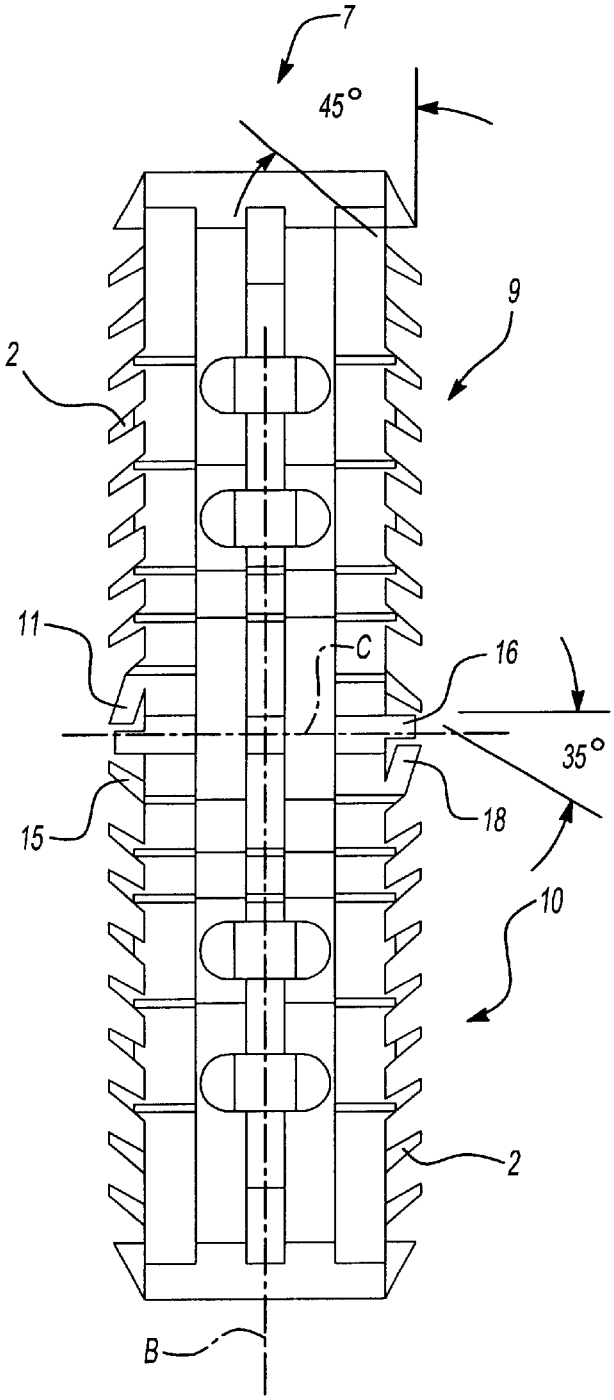
FIG. 5 is a schematical bottom view of a second embodiment of the linear connector.

As shown in FIG. 2 the connector body 1 comprises an U-configured cross-section for the passage or throughput of a hygroscopic drying substance powder and is radially reinforced in the center C of the body on both smaller lateral sides 3, 4 by protuberance-like reinforcing elements. According to the embodiment as shown in FIGS. 1 and 3 these reinforcing elements are provided with the reference numerals 5 and 6, respectively, whereas according to the embodiment as shown in FIG. 5 they are provided with the reference numerals 15 and 16, respectively. Each of these reinforcing elements are opposed by one abutment element in form of an elastic brake blade 7, 8 or 17, 18, respectively, inclined to the center C of the body. These brake blades are according to the embodiment as shown in FIGS. 1 and 3 not joined with the respective reinforcing element 5, 6 and will be pressed down and plastically deformed by the front face of the spacing profile against the respective reinforcing element 5, 6 upon the insertion of the linear connector body 1 into the hollow space of the spacing profiles, if this brake blade is located in the direction of insertion in front of the center C of the body, and in case in the direction of insertion the brake blade is located behind the center C of the body it forms an abutment for the spacing profile front face. By the term an abutment against insertion should be understood in this connection that the linear connector cannot be shifted beyond this abutment during insertion. Thus the linear connector cannot be inserted too far into the hollow space of the spacing profiles.

As can be gathered from the embodiment as shown in FIG. 5, the protuberance-like reinforcing elements 15, 16 are connected to the brake blades 17, 18 so that these brake blades are not so elastic as they are in the embodiment as shown in FIGS. 1 and 3. Nevertheless, they can be plastically deformed sufficiently during the insertion of the linear connector. On the other hand, the embodiment according to FIG. 5 guarantees that the grains of the hygroscopic powder which possibly enter into the space between the inner wall of the hollow spacing profile and the small lateral sides 3, 4 of the connector body 1 provided with the blades 2 do not enter from the area of the gap between the joined spacing profiles into the space between the glass panes, because this gap is absolutely sealed by means of the protuberance-like reinforcing elements 15, 16. Although such a seal can doubtlessly be gained by the embodiment according to FIGS. 1 and 3, it is required, however, that in this case the brake blades 7, 8 are tightly engaged by the reinforcing elements 5, 6, and such an engagement is only reached during the insertion of the connector body into the hollow space of the spacing profiles, whereas according to the embodiment of the connector body 1 of FIG. 5 such an engangement is present from the first of the beginning.

Figure 6:
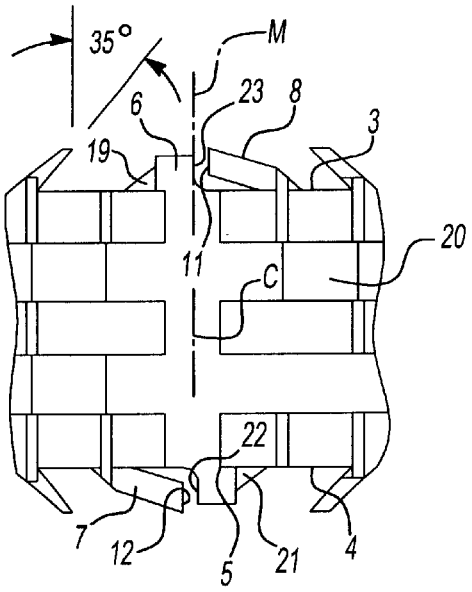
FIG. 6 is an enlarged detail view of the center area of the bottom of the linear connector according FIG. 3.
Figure 7:
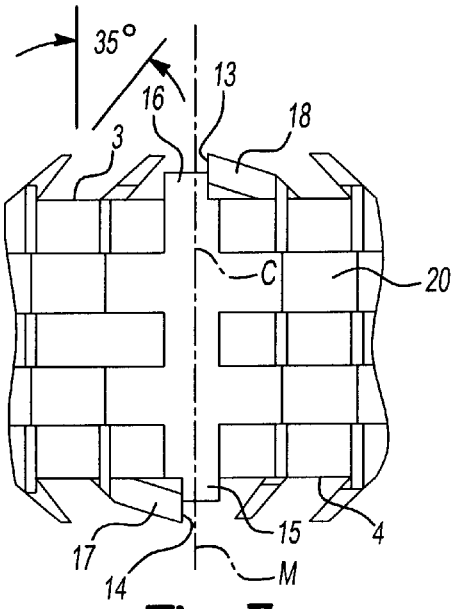
FIG. 7 is an enlarged detail view of the center area of the bottom of the linear connector according to FIG. 5.

Configuration and arrangement of the reinforce elements 5, 6 and 15, 16 as far as they are in cooperation with the related brake blades 7, 8 and 17, 18, respectively, can be gathered from the enlarged detail view of the center C of the body as shown in FIGS. 6 and 7. According to the embodiment of FIG. 6 one reinforcing element 5, 6 is configured as a protuberance extending from the small lateral sides 3 and 4, respectively, so far outwardly that it contacts the inner wall of the hollow spacing profile body which is to be shifted onto the linear connector on mounting. This protuberance is supported in the direction of insertion of the spacing profile, i.e. on its side opposite to the side of the brake blade 7, 8, by a wedge 19, 21 forming with the bottom 20 of the connector body 1 an entirety. The surface of the protuberance is located in the level of the bottom 20. That lateral surface 22, 23 of the reinforcing element 5, 6 located opposite to the front edge of the brake blades 7, 8 is positioned on the center axis M so that the two reinforcing elements 5, 6 are offset from one another with respect to this center axis, as can be seen from FIG. 6.

Concerning the embodiment according to FIG. 7 of the drawing the reinforcing elements 15, 16 are connected to the opposing brake blades 17, 18, so that they are not supported in the direction of insertion by the wedges 19 and 21 as shown in FIG. 6. The reinforcing elements 15 and 16 are, however, also part of the bottom 20 of the connector body 1, what means that they pass into the bottom and thus also close the gap of the two space keeping profile bodies to be joined against the space of the glass panes of the multiple insulating glass so that the particles of the hygroscopic powder cannot enter this space.

The above mentioned two embodiments of the linear connector are as shown in the Figures of the drawings and well known in the prior art provided at their parallel small lateral sides 3, 4 with projections in order to increase the friction between the surface of the linear connector 1 and the inner wall surface of the spacing profiles. These projections are comprised of inclined blades 2 distantly arranged in the longitudinal direction of the body under an angle of 35° to the longitudinal axis B of the body and projecting from the small lateral sides. The angle of adjustment of these blades at the one longitudinal piece 9 differs from that one of the other longitudinal piece 10 insofar as the blades 2 are directed against one another with respect to the center C of the body. These blades are elastic so that they can be elastically deformed if they contact the inner wall of the spacing profile upon insertion of the connector into the hollow space of the profile in order to develop frictional effects. In addition thereto, the brake blades 7, 8; 17, 18 also develop frictional effects or frictional forces at the inner wall of the spacing profile body ensuring the strong seat of the linear connector within the hollow space. The main function thereof, however, is to form an abutment on the insertion of the linear connector into the hollow space of the spacing profile body in order to stop the insertion from both sides at the center axis M. Therefore, the front faces 11, 12, 13, 14 of the inclined brake blades are positioned in the area of the center axis M at both sides thereof and in a very small distance thereto, as shown in FIGS. 6 and 7.

Figure 9:
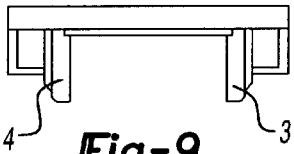
FIG. 9 is a schematical front view of the linear connector of FIG. 8.
Figure 8:
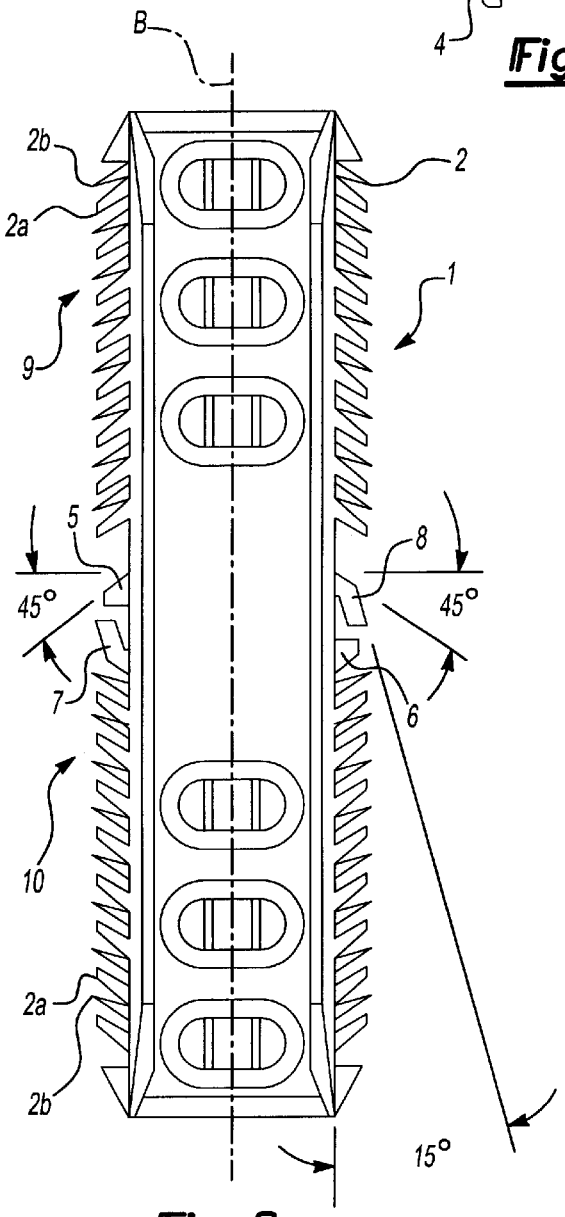
FIG. 8 is a schematical plan view of a third embodiment of the linear connector.

As can be seen from FIGS. 8 and 9 the body 1 of the linear connector of that embodiment is also provided with an U-cross-section and it is thus suited for the passage of the hygroscopic powder within that cross-section. It comprises as already shown in connection with the linear connector according to the embodiments of FIGS. 1–7, at its two small lateral sides 3, 4 protuberance-like reinforcing elements 5 and 6 directed outwardly, which are radially reinforcing the body. Each of which is opposed by an abutment element in form of an elastic brake blade 7, 8 inclined to the center C of the body, which brake blades, however, are not joined with the corresponding reinforcing elements 5, 6 and are also plastically deformed on the insertion of the body 1 into the hollow space of the spacing profile as shown in connection with the above mentioned described embodiments of the linear connector.

Figure 10:
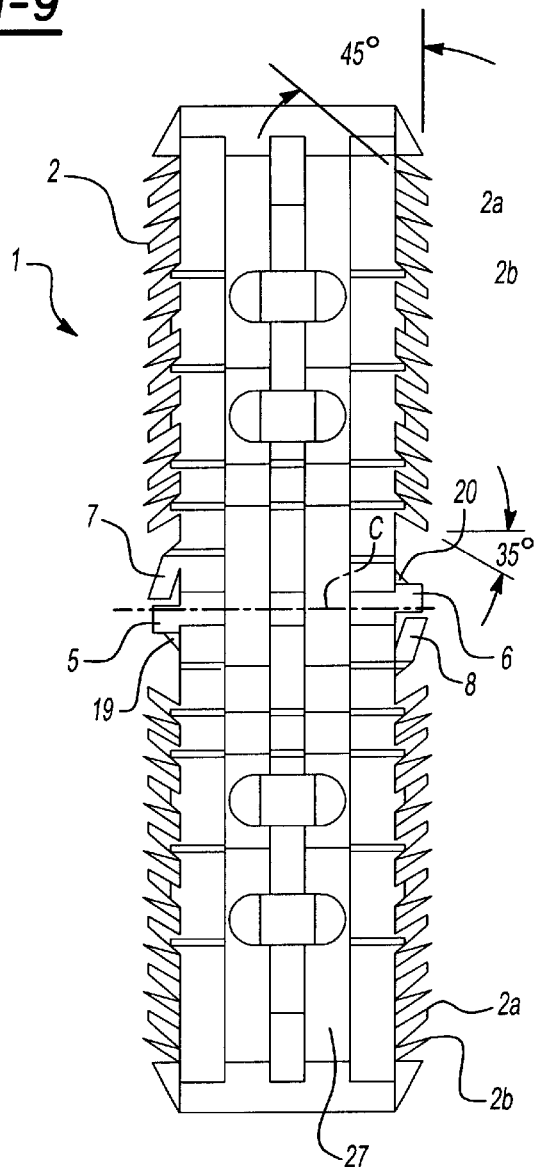
FIG. 10 is a schematical bottom view of the linear connector of FIG. 8.
Figure 11:
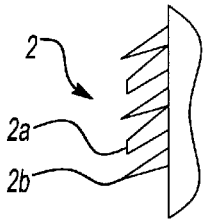
FIG. 11 is a lateral view of a detail of the double springs located at the small lateral sides of the body of the linear connector.
Figure 12:
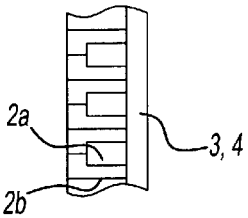
FIG. 12 is a detail view of the double springs according to FIG. 11 as a plan view.

The small lateral sides 3, 4 of the body 1 are as especially shown in FIGS. 8 and 10 provided with double springs 2 arranged one behind the other and extending blade-like outwardly from the small lateral sides. Each double spring is comprised of two spring blades 2*a*, 2*b* arranged behind one another and forming together in general a V-configuration and supporting one another, if the body 1 is mounted in the spacing profile. Details of this double spring arrangement and configuration are shown in FIGS. 11 and 12. As can be gathered therefrom the one spring blade 2*a* of the double spring 2 which is at the front with respect to the direction of insertion of the linear connector and thus the body 1 provided with a smaller angle of inclination with respect to the longitudinal axis B of the body as the other spring blade 2*b* behind. Moreover, the width of the two spring blades measured over the small lateral sides 3, 4 is different insofar as the width of the spring blade 2*a* at front is greater than that one of the spring blade 2*b* behind. The height of the spring blades, measured from the surface of the small lateral sides 3, 4 of the body, is in that embodiment equal. Because of that position and arrangement of the spring blades a supporting effect is raised on inserting the linear connector into the profile bodies to be joined and thus an approved frictional force between the tips of the spring blades and the inner wall of the profile bodies is gained. This supporting effect avoids an early fatigue of the material of the spring blades by bending strengths, because those bending strengths are at least partly balanced by the supporting forces caused by the common basis of the two spring blades forming the double springs 2.

As can be gathered from FIG. 10, the front spring blade 2*a* of each double spring 2 is inclined by an angle of 35° to the longitudinal axis B of the body. The angle of adjustment of that double spring at the one longitudinal piece 9 differs from the angle of adjustment of the other longitudinal piece 10 in such a way, that the double springs 2 are directed against one another with respect to the center C of the body. Not only the double springs 2, however, are elastically deformable so that they cause a frictional effect if they contact the inner wall of the spacing profile, but also the brake blades 7, 8 are elastically deformable in a certain extent if they come in contact with the inner wall of the hollow space of the profile upon insertion thereof The main object, however, of these brake blades is to effect as an abutment on the insertion into the spacing profile body in order to stop the insertion procedure on both sides at the center axis M. Therefore, the front faces of the brake blades are inclined by an angle of 45° to the longitudinal axis B of the body adjacent to the center axis M at both sides of that axis and in a relatively small distant from it so that the abutment effect can be realized.

Each protuberance-like reinforcing element 5, 6; 15, 16 may be an entirety either with a wedge 19, 21 extending from one of the small lateral sides 3, 4 of the body 1, or with one of the brake blades 7, 8 extending from the small lateral sides.

What is claimed is:

1. Linear connector for joining metal spacing profiles for multiple insulated glass panes, comprising:

a flat, longitudinal body adapted to be inserted into a hollow space of a first spacing profile and a hollow space of a second spacing profile which is to be joined to the first spacing profile, said body having a substantially U-configured cross-section that is adapted for the passage of a hygroscopic powder and including, at least two abutment elements, said abutment elements comprising elastic brake blades that are positioned along lateral sides of said body and are inclined toward the center of said body, said brake blades being adapted to contact opposing front faces of the spacing profiles upon insertion of the linear connector into the spacing profiles to form an insertion abutment, at least a first and a second spring blade that project from the lateral sides of said body, said spring blades being positioned behind one another to form a V-configuration and being adapted to increase the frictional force between the surface of the body and inner wall surfaces of the spacing profiles and each of said spring blades supporting each other following insertion of said linear connection into a spacing profile, and a first and a second outwardly directed protuberance reinforcing element that are centrally positioned respectively along lateral sides of said body and connected to said brake blades, said reinforcing elements being adapted to bar passage of hygroscopic powder on the outside of the body.

2. The linear connector according to claim 1, wherein each protuberance reinforcing element further comprises a wedge.

3. The linear connector according to claim 1, characterized in that the first and second reinforcing elements extend so far outwardly that they contact the inner wall of the hollow spacing profiles into which the linear connector is inserted.

4. The linear connector according to claim 1, characterized in that the first and second reinforcing elements each comprise a lower surface that is planar with a bottom of the body.

5. The linear connector according to claim 1, characterized in that the first spring blade that is located with respect to the direction of insertion of the body of the linear connector in front, comprises an angle of inclination with respect to the longitudinal axis of the body which is smaller than the second spring blade which is located behind the first spring blade.

6. The linear connector according to claim 1, characterized in that the widths of the first and second spring blades are different.

7. The linear connector according to claim 6, characterized in that the width of the first spring blade is greater than that of the second spring blade.

8. The linear connector according to claim 1, characterized in that the height of the first and second spring blades is different.

9. The linear connector according to claim 8, characterized in that the height of the first spring blade which is in front as seen in the direction of insertion of the linear connector is greater than that of the second spring blade.

10. The linear connector according to claim 2, characterized in that the reinforcing elements extend so far outwardly that they contact the inner wall of the hollow spacing profiles into which the linear connector is inserted.

* * * * *